United States Patent [19]

Piepmeier

[11] Patent Number: 4,517,495

[45] Date of Patent: May 14, 1985

[54] MULTI-ELECTRODE PLASMA SOURCE

[76] Inventor: Edward H. Piepmeier, Oregon State University, Department of Chemistry, Corvallis, Oreg. 97331

[21] Appl. No.: 420,749

[22] Filed: Sep. 21, 1982

[51] Int. Cl.[3] ..... H01J 7/24; H05B 31/26

[52] U.S. Cl. ..... 315/111.21; 219/121 P; 313/231.31; 313/231.51; 315/111.11; 315/137; 315/145

[58] Field of Search ..... 315/111.11, 111.21, 315/137, 145, 147; 356/316; 219/121 P; 313/231.3, 231.5, 306, 307, 231.31, 231.51

[56] References Cited

U.S. PATENT DOCUMENTS

| | | | |
|---|---|---|---|
| 3,248,513 | 4/1966 | Sunnen | 315/137 X |
| 3,283,205 | 11/1966 | DeBolt | 315/145 X |
| 3,312,566 | 4/1967 | Winzeler et al. | 219/76.16 |
| 3,324,334 | 6/1967 | Reed | 313/231.31 |
| 3,617,596 | 11/1971 | DeCorso | 13/31 |
| 3,684,884 | 8/1972 | Bordonali et al. | 422/69 |
| 3,930,139 | 12/1975 | Bykhovsky et al. | 219/121 P X |
| 3,959,104 | 5/1976 | Fales | 204/164 |

OTHER PUBLICATIONS

Bonet et al., "High Power Plasma Flows", International Conference on Gas Discharges, London, 1970, pp. 236–240.

Fassel et al., "Inductively Coupled Plasmas", Analytical Chemistry, vol. 46, No. 13, Nov. 1974.

Bonet et al., "Comportement de Divers Utilises Comme Electrodes d'un Generateur de Plasma en Courant Alternatif Triphase, *J. Phys.,* D vol. 9, 1976, pp. L141–L147.

Radovanov et al., "Formation of the AlF Radical in a Horizontal Arc Established Inside a Graphite Tube", *Plasma Physik,* 1976, pp. 345–349.

Keirs et al., "dc Plasma Arcs for Elemental Analysis", *Applied Spectroscopy,* vol. 31, No. 4, 1977, pp. 273–283.

Vukanovic et al., "The Rotation of Two Low-Current Arc Plasmas in a Graphite Tube", International Conference on Phenomena in Ionized Gases, Berlin, 1977, pp. unknown.

Greenfield, "The Inductively Coupled Plasma Torch–A Source For All Reasons", *The Spex Speaker,* Sep., 1977, pp. 1–6.

Fairless, "Studies on the Industrial Analytical Utility of a Direct Current Discharge Plasma", *American Laboratory,* Mar. 1978, pp. 101–109.

Ward, "Inductively Coupled Argon Plasma Spectroscopy", *American Laboratory,* Nov., 1978, pp. 79–87.

Reednick, "A Unique Approach to Atomic Spectroscopy", *American Laboratory,* Mar., 1979, pp. 53–62.

Fassel, "Inductively Coupled Plasma–Atomic Emission Spectroscopy", *Analytical Chemistry,* vol. 51, No. 13, Nov., 1979, pp. 1291A–1308A.

*Primary Examiner*—Saxfield Chatmon

*Attorney, Agent, or Firm*—Kolisch, Hartwell and Dickinson

[57] ABSTRACT

A multi-electrode plasma source for maintaining a plasma loop for heating a stream of sample material traveling along a predetermined path through the loop. Included is at least one set of at least three spaced-apart electrodes having tips circumferentially distributed about such a stream path. Voltages are applied to the electrodes and plasma gas is directed into the region of the tips. The tip distribution, voltages and plasma gas flow are appropriate to generate electrical plasma generally surrounding the path.

9 Claims, 4 Drawing Figures

MULTI-ELECTRODE PLASMA SOURCE

BACKGROUND AND SUMMARY OF THE INVENTION

This invention pertains to a method and apparatus for supporting a plasma loop, and specifically for such a method and apparatus in which voltages are applied to and plasma gas is directed about at least three electrodes which are distributed to maintain the plasma.

The purpose of the present invention, although not limited to this particular application, is to provide a hot plasma (ionized gas) region that will atomize analytical samples and excite the resulting analyte atoms so that they emit light of characteristic wavelengths. The invention can be used and practiced with a spectrometer that measures intensity of the emitted light, which measurements can then be used to determine the concentrations as chemical elements in the sample. Alternately, the atoms produced by the invention can be observed by atomic absorption or atomic fluorescence spectrometers, which can also help determine the concentrations of chemical elements in the sample.

The need for simultaneously determining high and low level concentrations of many chemical elements in a variety of different types of samples (e.g., biological, environmental, geological, industrial) has lead to the development over the last decade of emisson spectrometers capable of determining twenty to forty elements at once in a given sample. In one type of instrument known as an induction coupled plasma source, the sample in liquid form is nebulized into an argon (or other plasma gas) stream and swept into an argon plasma. Although other plasma gases can be used, argon is desirable because it is inert. The plasma is maintained by inductively coupling several kilowatts of power into the plasma from a radio-frequency power source. The high temperature of the plasma (5,000°–10,000° C.) atomizes the sample and excites the free atoms. Spontaneous emission from the analyte atoms is detected photoelectrically by a multi-channel (20–40 element) direct-reader spectrometer. The intensity measurements are related to concentrations of the elements in the original sample by the use of standard samples. The plasma is analogous to analytical flames used in common atomic absorption instruments. However, the much hotter temperature of the plasma reduces interferences caused by matrix effects, and increases the emissions of the analyte atoms to the point that the emission signal gives better detection limits than the atomic absorption signal.

In another design, the argon plasma is maintained by passing a direct current of five to ten ampers through the plasma between a pair of electrodes. This type of plasma is easier to generate and does not blow out as easily as the induction coupled plasma under varied operation conditions. An argon stream containing the nebulized samples is directed at the plasma. However, the hot plasma tends to repel the cooler argon stream, and consequently most of the sample passes around and does not come in contact with the hottest part of the plasma. This problem occurred initially for the induction coupled plasma, and was solved by controlling the experimental conditions so that the hot core of the plasma formed a doughnut-shaped region. The sample stream passes through the center of the doughnut forcing it to come into contact with the hotter regions of the plasma. Both the argon DC arc plasma and the induction coupled plasma are commercially available as complements of instruments costing several tens of thousands of dollars.

A third plasma-generating source of which applicant is aware is used for producing high power plasma flows. It includes a set of three electrodes having concurrent axis pointed in a direction corresponding with a desired direction of plasma flow. A pilot plasma jet is directed in the desired direction of plasma flow. Three-phase electric power is applied to the electrodes and a separate jet of plasma gas is directed longitudinally along each electrode into the main plasma jet such that a tripod-shaped plasma is generated. This plasma source, if used for sample analysis, would have the same disadvantage with respect to heating a stream of sample material as does the DC source previously described.

It is therefore a general object of the present invention to overcome many of the problems exhibited in the prior art.

In particular, it is an object to provide a plasma source which produces plasma in the form of a loop through which sample material may be directed for analysis.

It is a further object of this invention to provide such a source which may be designed to support a variety of plasma loop shapes and sizes.

It is also an object to provide a plasma source in which the thickness of the plasma in the direction of sample flow may also be controlled.

Additionally, it is desired to provide such a source is relatively inexpensive as compared to existng plasma loop sources.

The present invention provides an apparatus and a method for using the apparatus, in which at least three electrodes are distributed in a set circumferentially about a path along which a stream of sample material flows. Plasma gas is directed in the region of these electrodes and voltages are applied, relative to the tip distribution, to maintain a plasma generally surrounding the path.

In the preferred embodiment of the apparatus of the present invention, the electrodes are disposed in a horizontal plane normal to the travel path of such a sample stream. The electrode tips are disposed equidistant from each other about the sample stream and three-phase voltages are applied to them. Argon gas is projected cylindrically in the direction of stream flow outside the periphery of the electrode tips. The sample is entrained in argon gas to form an aerosol sample stream. Finally, argon gas is directed longitudinally along each electrode in order to cool it. This latter flow is limited to a flow rate which is insufficient to cause the plasma to block the centrally-disposed stream path. Optionally, a plurality of electrode sets may be disposed longitudinally along the sample stream travel path in order to extend the length of plasma produced thereby.

The positions of the electrodes may be altered and the applied voltages varied correspondingly to alter, the size and shape of the plasma produced. Also, it is anticipated, different numbers of electrodes may be distributed within each set and voltages applied appropriately to support plasma loops having other sizes and shapes.

These and additional objects and advantages of the present invention will be more clearly understood from a consideration of the drawings and the following detailed description of the preferred embodiment.

DESCRIPTION OF THE PREFERRED EMBODIMENT

Figure 1:
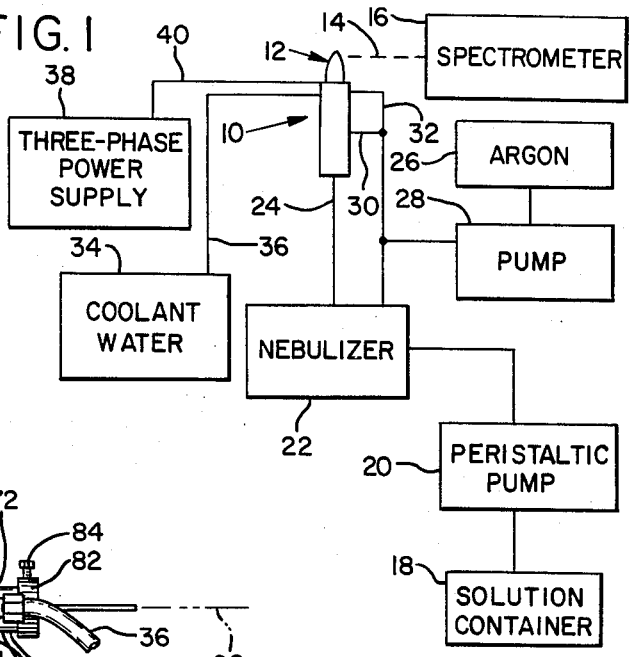
FIG. 1 is a block diagram showing generally a use of this invention in spectrometry.

Referring initially to FIG. 1 and explaining a system for supporting a loop-shaped plasma for use in spectrometry, a plasma source, shown generally at 10, is operable to maintain a sample-entrained plasma plume 12. The light emitted from the atomized sample is viewed along an emission-viewing corridor 14 for measurement by a spectrometer 16. Such spectrometers are commercially available and are chosen according to the type of sample and analysis being performed. The applicant uses an Aminco Grating Monochromator for analyzing copper, sodium and aluminum samples. Other assorted supporting instrumentation is also used, all of which is also commercially available, known in the art, and is chosen to fit the particular user's budget and application.

Typically, an aqueous or liquid organic solution of sample material is prepared and placed in a solution container 18, which solution is connected to a peristaltic pump 20 for delivery to a nebulizer 22. Cole-Parmer and Fisher Scientific Company respectively produce commercially available peristaltic pumps and nebulizers. A Babbington-type nebulizer may also be used. Nebulizer 22 produces an aerosol stream of sample material entrained in argon gas. This stream is directed to source 10 through a connecting quartz tube 24. A supply of argon 26 is transferred to nebulizer 22 through a pump 28, or other pressured system, with appropriate valving. The argon is also connected to source 10 by a general supply tube 30 and by an electrode-supply tube 32.

A coolant water supply 34 is connected to source 10 through a water supply tube 36 for cooling electrodes used therein.

A three-phase power supply 38, also referred to herein as voltage-applying means, is connected appropriately electrically to an each source electrode through a connector 40. As is readily apparent, the average voltage between the three phases is the same. Also, there exists what may be referred to as an absolute phase difference between the phases of 120°. In power supply 38 a commercially available interphase voltage of 208 volts (RMS) is reduced with a three-phase wye-connected transformer to 104 volts (RMS). Series power resistors (nominally 1 ohm, 400 watt) are used to further reduce the voltages applied to the electrodes, and limit the current to 24 amps (average). The actual resistances of the power resistors varied up to 2 ohms during operation because of heating. These additional features of the power supply, not shown, may be varied to suit other applications.

Figure 3:
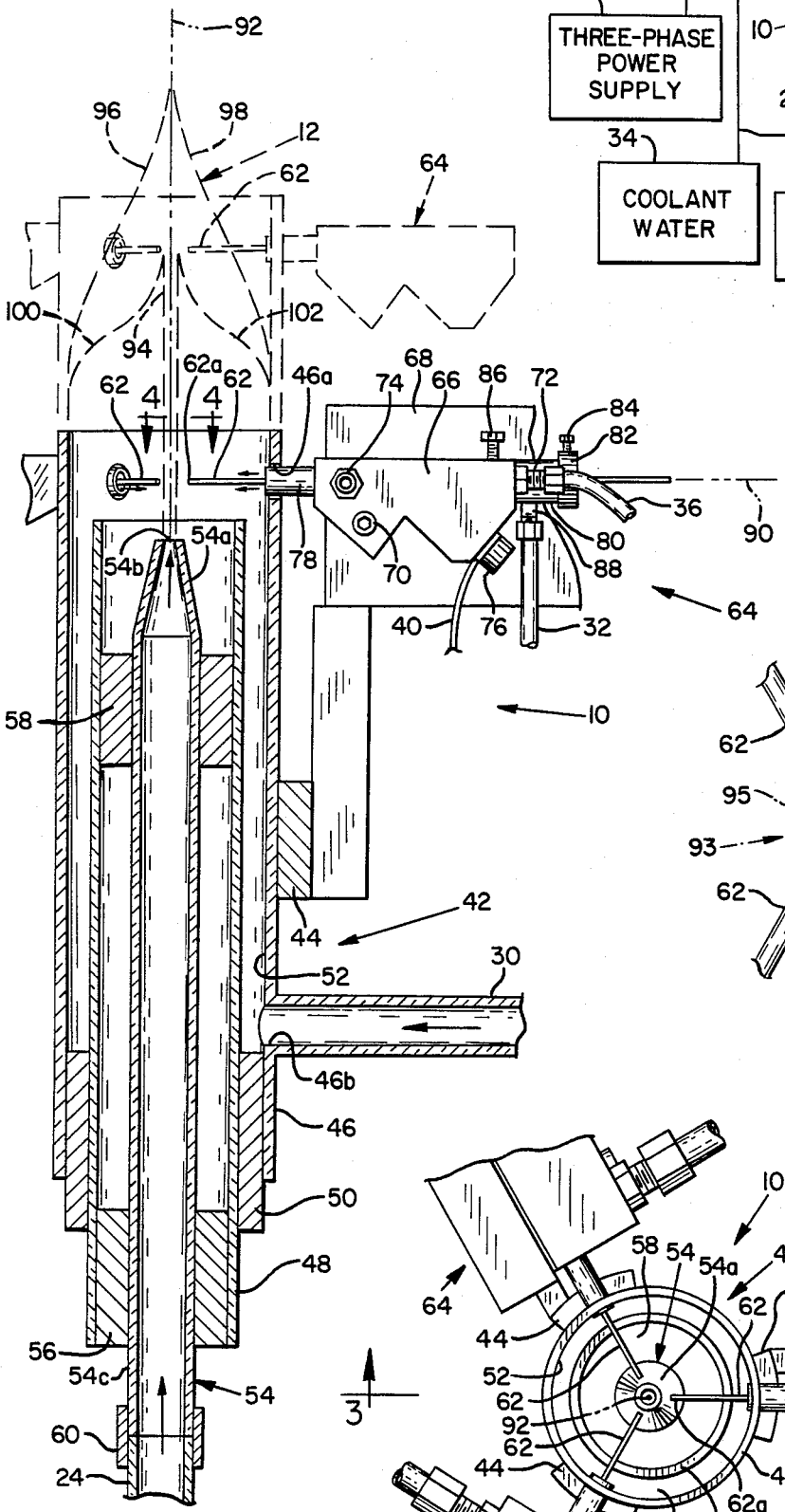
FIG. 3 is a fragmentary cross-sectional view of the source of FIG. 2 taken along line 3—3 therein.
Figure 2:
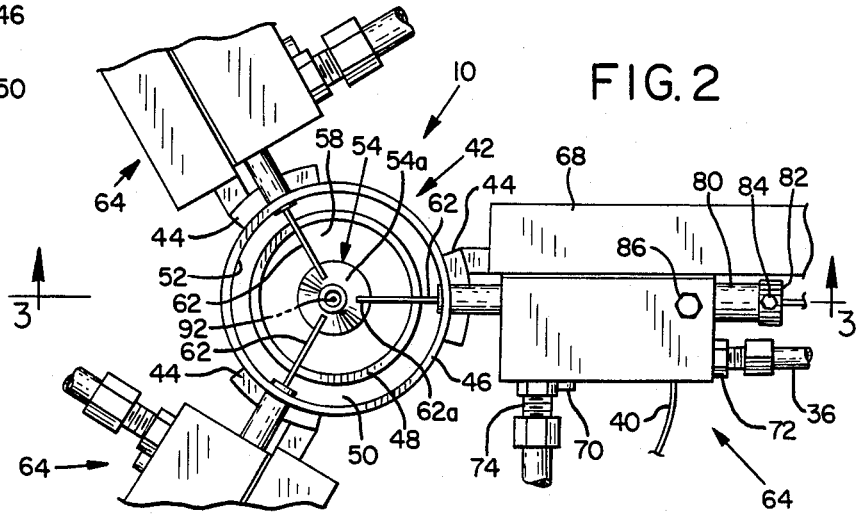
FIG. 2 is a simplified fragmentary top view of a plasma source useable as the source of FIG. 1.

Referring now to FIGS. 2 and 3 and explaining construction of the preferred embodiment of plasma source 10, a quartz tubing assembly, shown generally at 42, is used to supply argon for plasma generation and to introduce a sample aerosol stream into the center of the plasma. Assembly 42 is attached to a suitably supporting structure such as the tube-clamping elements shown, including element 44.

Included in assembly 42 is an outer tube 46 having a 21 millimeter outer diameter and a 19 millimeter inner diameter.

Concentrically mounted within tube 46 is an intermediate tube 48 having a 13.5 millimeter outer diameter and a 12.5 millimeter inner diameter. Tube 48 is held in position relative to tube 46 by an aluminum spacer 50 which completely fills the space between the two tubes and forms the bottom of an argon gas supply chamber 52. This tubular-shaped chamber is also defined by tubes 46, 48 and is open at the top, as shown.

Concentrically mounted within intermediate tube 48 is an inner tube 54 having a preferred inner diameter of 7 millimeters and an outer diameter of 8 millimeters. Tube 54 is held in position within tube 48 by appropriate aluminum spacers, such as spacers 56, 58, as shown. The upper end of tube 54 terminates in a nozzle **54*a* which is tapered to a circular orifice 54*b* at its tip which has an exit diameter of 0.3 millimeters. A lower or inlet end 54*c* is connected to connecting tube 24, also made of quartz, by a suitable coupling 60**.

Intermediate tube 48 terminates at its upper end 3 millimeters above orifice **54*b*. Disposed within the sides of outer tube 46, centered at a point 10 millimeters above orifice 54*b*, are three 7-millimeter-diameter bores, such as bore 46*a*. These bores are disposed 120% apart about the circumference of tube 46, as can be seen particularly in FIG. 2**.

In a lower side of outer tube 46 is an inlet opening **46*b* disposed above spacer 50. General supply tube 30 is attached to tube 46 around inlet 46*b*, providing thereby, communication between the inside of tube 30 and chamber 52**.

Disposed in the upper end of tube 46 are a set of three electrodes, such as electrode 62. Electrodes 62 are held in position and cooled during operation by the use of what are loosely termed herein as electrode holders, such as the electrode holder shown generally at 64. Each electrode holder 64 has a metal body 66 which is fixedly mounted on a plexi-glass support plate 68 by a bolt 70. Plate 68 is fixedly attached to support elements 44 by appropriate attaching means not shown. Body 66 provides both support and cooling for electrodes 62. Water supply tube 36 is connected to a water inlet 72 which is connected to heat transfer chambers within body 66 and finally to a water outlet 74.

Power connector 40 is connected to electrode 62 through body 66 by attachment at an electrical terminal 76. Each electrode is connected to a different-phase voltage from power supply 38.

Electrode 62 is held in position through bore **46*a* by a ceramic sleeve 78 which snugly fits in the bore. Sleeve 78 is fixed to body 66. At the end of body 66 opposite from sleeve 78 is mounted a removable sheath 80. Electrode 62 is held in position in holder 64 by a thumb screw 82 and a bolt 84 which clamps against the electrode. Sheath 80 is held in place in body 66 by a bolt 86. Assembly 64 is constructed to receive argon gas from supply tube 32 through a gas inlet 88. Passageways, not shown, are provided for transmission of argon gas from inlet 88 along the electrode within body 66 and sleeve 78 and outwardly longitudinally along the electrode toward its inner tip 62*a* disposed within tube 46. Electrode holder 64**, or its quivalent, is available commercially from Spectro-Metrix, Inc. or other appropriate firms.

The argon supply equipment, conduits and passageways associated with and forming parts of source 10 are also referred to herein as plasma gas flow directing means.

Electrodes 62 are positioned in a horizontal plane shown as dash-double-dot line 90 in FIG. 3, are spaced equidistantly 5 millimeters apart, and are spaced equidistantly from the vertical longitudinal axis of tubes 46, 48, 54, which axis is shown by vertical dash-double-dot line 92 in FIG. 3.

In solid lines in FIG. 3, a single set of coplanar electrodes are shown. It is also contemplated in the present invention that additional sets of electrodes may be disposed along an extension of outer tube 46, and therefore along axis 92, in order to lengthen plasma produceable by source 10. A spacing of several centimeters between sets will assure electrical isolation between them. Such an additional set is shown in phantom lines in FIG. 3 in the top of source 10.

OPERATION

Prior to igniting a plasma arc, the coolant water, power supply fans, power supply and argon are turned on in that order. The voltages applied by the power supply has previously been discussed. The argon flowing in the electrode holders and therethrough into the plasma region around electrode 62 in tube 46 flows at a rate of 0.5 liters per minute. This was found to be the minimum effective flow rate for cooling the electrodes, while flow rates above 2 liters per minute distort the plasma shape sufficiently to interfere with the sample flow.

The argon flow rate through chamber 52 is preferably about 9 liters per minute for most emission spectrometry applications. A range of between 3 liters per minute and 10 liters per minute is sufficient for ignition of the plasma. In order to reduce sample aerosol condensation in connecting tube 24 heat may be applied to it. Heating coils made of nichrome wire, not shown, may be wrapped around the tube and 25 watts of power supplied. This heating of the sample aerosol also reduces the plasma power requirements for heating and desolvating entrained sample droplets. If such heating is used, it should be turned on prior to transmission of the aerosol sample through tube 24.

Figure 4:
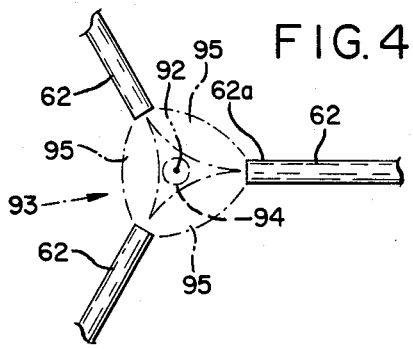
FIG. 4 is a simplified partial top view of the source of FIG. 3 taken along line 4—4 therein.

The electrodes are ignited in one ignition method by using a 3.5 centimeter long, 12-millimeter-diameter piece of graphite which is placed to touch all three electrodes. It may be fixed in the end of a 15 centimeter long, 12-millimeter-inner diameter pyrex tube. The graphite is removed upon ignition of the plasma. With plasma existing between the electrodes, with argon flowing, and with three-phase power being applied to the electrodes, a generally triangle-shaped, centrally apertured plasma, shown generally at 93 in FIG. 4, is maintained. The perimeter of plasma 93, defined by tips 62*a*, encompass what may also be referred to as a plasma maintenance expanse.

During operation, a plasma 95 exists between each pair of adjacent electrodes, as shown in FIG. 4, which plasmas form the three legs of plasma 93. Although the voltage between any two adjacent pairs of electrodes is zero two times during each complete voltage cycle, the plasma therebetween does not extinguish. Since plasmas are formed from heated gases, they continue to exist so long as they remain sufficiently hot. Thus, plasmas 95 tend to modulate in intensity in response to variations in the applied voltages, but they do not extinguish completely at any time.

In fact, it is important in the operation of a source such as this, particularly where voltages other than polyphase voltages may be applied to the electrodes, that the plasma never be allowed to completely extinguish at any time. So long as there is at least some residual plasma, a proper voltage differential between two electrodes adjacent the plasma can reestablish it to a desired level.

Once the plasma has been established the sample aerosol is injected through tube 24 and inner tube 54 and out orifice 54*b* along a path 94 generally following axis 92. This path is shown by dashed vertical lines 94 in FIG. 3 and dashed circular line 94 in FIG. 4. The aerosol stream, therefore, tends to follow path 94 along axis 92, which axis may also be referred to as a transport axis for the stream. The sample aerosol flows at a rate of about 1 liter per minute.

The upper converging dashed lines 96, 98 shows generally (not to scale) the observed shape of the overall plume 12 which is produced as a result of operating plasma source 10 as described. This plume includes, again identified very roughly and not to scale, a main sample-heating plasma whose upper boundaries are illustrated by dashed lines 100, 102 which converge upwardly on path 94.

The electrodes used in the preferred embodiment just described, were approximately 1-millimeter-diameter, two percent thoriated tungsten electrodes, obtainable commercially from such firms as Teledyne Wah Chang. As new electrodes 62 heat, they form a molten globual on tips 62*a*, which reaches a maximum diameter of approximately two millimeters. This globual is found to have no adverse effect on plasma arc, particularly with respect to arc wander. During operation, the electrodes decrease in length at a rate of approximately 1 millimeter per hour. Therefore, over prolonged periods of operation, the electrodes need to be adjusted through the electrode holder to maintain the desired spacing.

It can be seen that a plasma source made in conformance with the present invention provides for generating a loop-shaped plasma which substantially surrounds, and therefore entrains, a stream of sample material along a path which passes through the apertured center of the plasma. The electrode tips are seen to define a triangular perimeter which surrounds axis 92 and path 94. The previously discussed use of inductively-coupled plasma generators has taught that advantages exist for entraining a sample within plasma as compared to conventional DC source. The use of commonly available three-phase power supplies to generate a similar plasma has the advantage of being less costly. Additionally, other types of power supplies provide additional capabilities. By constructing plasma sources according to this invention with different numbers and distributions of electrodes, with voltages being applied appropriate to each particular configuration, both the shape and size of plasma produced thereby is controlled. Additionally, as has been briefly mentioned in the foregoing discussion, such sets of electrodes may be stacked along the sample stream travel path in order to extend the heating time of a sample entrained therein.

While the invention has been particularly shown and described with reference to the foregoing preferred embodiment, it will be understood by those skilled in the art that other changes in form and detail, such as those just discussed, may be made therein without departing from the spirit and scope of the invention as defined in the following claims.

It is claimed and desired to secure by Letters Patent:

1. A multi-electrode plasma source usable for heating a stream of sample material traveling along a predetermined path comprising at least one set of at least three spaced-apart electrodes having tips circumferentially distributed about the path in a manner defining a perimeter enclosing the path, means for applying voltages to said electrodes in such a manner that the maximum average voltage between any one electrode and the other electrodes exists between said one electrode and a circumferentially adjacent electrode, and means for directing flow of plasma gas into the region of said tips with the flow including flow portions extending between each pair of circumferentially adjacent electrodes, such tip distribution, voltages and plasma gas flow being appropriate to maintain electrical plasma generally surrounding such a path and extending substantially only between adjacent pairs of electrodes, the plasma thereby forming a substantially closed-loop plasma expanse having a central, generally plasma-free aperture through which the path extends with the plasma gas not flowing toward the path at a flow rate sufficient to effectively extinguish the aperture.

2. The source of claim 1, wherein said voltage-applying means is constructed to apply time-varying voltages to said electrodes in such a manner that, prior to extinguishment of such plasma, appropriate voltages are applied to at least one electrode adjacent the plasma and to another electrode circumferentially adjacent said one electrode to maintain electrical plasma therebetween.

3. The source of claim 2, wherein said voltage-applying means, with reference to the time-varying voltages mentioned above, further is constructed to create a polyphase relationship between the voltages in a manner whereby those voltages applied to any two circumferentially adjacent electrodes within the set are of different phases and the maximum absolute phase difference between any two electrodes exists between two circumferentially adjacent electrodes.

4. A multi-electrode plasma source useable for heating a stream of sample material traveling along a predetermined path having a known transport axis, said source comprising at least three electrodes having tips disposed about such a path in a plane substantially normal to the transport axis, said tips being equidistant from the axis and equidistant from each other, means for applying to said electrodes polyphase voltages in such a manner that the maximum average voltage between any two electrodes exists between two circumferentially adjacent electrodes, and means for directing a flow of plasma gas in the region of said electrode tips in a direction generally paralleling the path with the flow including flow portions extending between each pair of circumferentially adjacent electrodes, such voltages and plasma gas flow being appropriate to maintain electrical plasma generally surrounding such a path and extending substantially only between adjacent pairs of electrodes, the plasma thereby forming a substantially closed-loop plasma expanse having a central, generally plasma-free aperture through which the path extends.

5. A method of supporting a generally closed-loop-shaped, centrally apertured plasma using at least three electrodes having tips distributed so as to define generally the perimeter of a plasma maintenance expanse, said method comprising the steps of applying voltages to such electrodes appropriate to maintain elongated electrical plasmas each extending only between the tips of circumferentially adjacent electrodes, and simultaneously with said applying, directing flow of plasma gas into such expanse with the flow including flow portions extending between each pair of circumferentially adjacent electrodes, said directing not being toward the path at a flow rate sufficient to effectively extinguish the aperture and being in a manner cooperating with such voltages to assure preservation of such plasmas under all circumstances in a condition, substantially, of end-to-end contact only, whereby the plasmas collectively define the desired loop.

6. A plasma source useable for heating a stream of sample material traveling along a predetermined path having a known transport axis, said source comprising three electrodes having tips disposed radially about such a path defining a triangle surrounding the transport axis, means for applying to said electrodes three-phase voltages, and means for directing a flow of plasma gas in the region of said electrode tips predominantly in a direction generally paralleling the path with the flow including flow portions extending between each pair of circumferentially adjacent electrodes, such tip distribution, voltages and plasma gas flow being appropriate to maintain electrical plasma extending substantially only between each pair of electrodes with the plasmas forming a substantially closed-loop plasma expanse having a central, generally plasma-free aperture through which the path extends.

7. A method of heating a stream of sample material traveling along a predetermined path using at least three electrodes circumferentially disposed about the path in a manner defining a perimeter enclosing the path, comprising the steps of applying polyphase voltages to the electrodes, simultaneously with said applying, directing flow of plasma gas into the region between the electrodes predominantly in a direction generally paralleling the path with the flow including flow portions extending between each pair of circumferentially adjacent electrodes, by said applying and directing, maintaining only an elongated electrical plasma extending between the tips of each pair of circumferentially adjacent electrodes, the combination of plasmas forming a substantially closed-loop plasma expanse with a central, generally plasma-free aperture through which the path extends, and directing a stream of sample material along the path through the aperture.

8. A method of heating a stream of sample material traveling along a predetermined path using three electrodes circumferentially disposed about the path in a manner defining a triangle substantially enclosing the path comprising the steps of applying three-phase voltages to the electrodes, simultaneously with said applying, directing flow of plasma gas into the region between the electrodes with the flow including flow portions extending between each pair of circumferentially adjacent electrodes, by said applying and directing, maintaining only an elongated electrical plasma extending between the tips of each pair of circumferentially adjacent electrodes with said directing not being toward the path at a flow rate sufficient to effectively extinguish the aperture, forming thereby, a substantially closed loop plasma expanse having a central, generally plasma-free aperture through which the path extends, and directing a stream of sample material along the path through the aperture.

9. A method of heating a stream of sample material traveling along a predetermined path using first, second and third electrodes having tips substantially equally circumferentially distributed about the path comprising the steps of applying equally-phased three-phase voltage to the electrodes with one phase applied to the first electrode, a second phase applied to the second electrode, and the third phase applied to the third electrode, simultaneously with said applying, directing a flow of plasma gas in a direction generally paralleling the path with such flow including one flow portion extending between the first and second electrodes, a second flow portion extending between the second and third electrodes, and a third flow portion extending between the third and first electrodes, producing thereby a substantially closed-loop plasma expanse having a generally plasma-free central aperture through which the path extends, and directing the stream of sample material along the path and through the aperture with the stream being heated by the surrounding plasma.

* * * * *